United States Patent [19]

Flynt et al.

[11] 4,089,572

[45] May 16, 1978

[54] MULTIPLE POSITION SEWING MACHINE CABINET

[76] Inventors: Larry Charles Flynt, 4858 Kernersville Rd.; Robert Clinton Flynt, Jr., 4864 Kernersville Rd., both of Kernersville, N.C. 27284

[21] Appl. No.: 761,684

[22] Filed: Jan. 24, 1977

[51] Int. Cl.[2] ..... A47B 81/00

[52] U.S. Cl. ..... 312/27; 312/22; 312/29; 112/217.1

[58] Field of Search ..... 312/20, 21, 27–30; 112/217.1, 258, 260

[56] References Cited

U.S. PATENT DOCUMENTS

| | | | |
|---|---|---|---|
| 2,398,696 | 4/1946 | Colegrove | 312/28 |
| 3,765,739 | 10/1973 | Williams | 312/30 |
| 3,788,716 | 1/1974 | Roberts et al. | 312/29 |
| 3,986,755 | 10/1976 | Kohara | 312/21 |

*Primary Examiner*—Casmir A. Nunberg
*Attorney, Agent, or Firm*—Hugh C. Bennett, Jr.

[57] ABSTRACT

A multiple position sewing machine cabinet to house in storage and operative positions a drophead sewing machine of the type adapted for use in multiple operative positions. Movement of the sewing machine from a horizontal, stored position within the cabinet to one or more vertically-elevated, operative positions above the cabinet is accomplished by a follower and guide mounting assembly. The machine is secured to a base plate having pairs of spaced-apart lugs extending outwardly from opposite edges thereof. A pair of spaced guide grooves receive the spaced-apart lugs and selectively guide movement of the base plate, with the machine attached thereto, through one or more operative positions and into storage position.

3 Claims, 8 Drawing Figures

MULTIPLE POSITION SEWING MACHINE CABINET

BACKGROUND OF THE INVENTION

1. Field of the Invention.

This invention relates to a novel mounting assembly for slidably mounting a drophead sewing machine to a cabinet and permitting movement of the machine from a horizontal, stored position within the cabinet to one or more vertically-elevated, operative positions above the cabinet.

2. Description of the Prior Art

Sewing machine cabinets adapted to both house a sewing machine when not in use and provide a work table therefor when in use are well known in a variety of different forms with, for example, the embodiments disclosed in U.S. Pat. Nos. 2,398,696 and 2,887,350, to mention a few, being illustrative thereof. The prior art cabinets, however, are: complicated, both as to construction and maintenance; unhandy to use because in many cases of spring tensions that must be counterpoised in moving the machine through its operative and storage positions; and, expensive to produce. Furthermore, prior art cabinets of the type contemplated, so far as is known, do not permit horizontal storage of the machine therein which requires a deeper cabinet to accommodate the machine in its tilted-storage position, thereby increasing the cabinet's manufacturing cost and presenting difficulty in the cabinet's design. Although multiple position cabinets have been provided with guide and follower assemblies to guide movement of the machine through various operative and storage positons, such assemblies have never been successfully adapted to cabinets for free-arm sewing machines and the support thereof in multiple positions with a horizontal storage position, so far as applicant is aware.

SUMMARY OF THE INVENTION

The present invention overcomes the above-discussed prior art deficiencies by providing a novel follower and guide mounting assembly for slidably mounting the sewing machine heat to the cabinet and permitting its movement from a horizontal, storage position within the cabinet to one or more vertically-elevated, operative positions above the cabinet. The assembly includes a base plate, having length and depth dimensions to accommodate the corresponding dimensions of the sewing machine head secured thereto by any suitable fastening means. A pair of spaced-apart follower members or lugs extend outwardly from opposite ends of the base plate and cooperate with a spaced guide means, comprising a pair of spaced guide grooves, each of said grooves receiving one pair of said spaced-apart lugs, to guide movement of the machine, attached to said base plate, through one or more vertically-elevated, operative positions and into a horizontal, storage position. The spaced guide means includes a pair of parallel, spaced-apart wall members with each wall member having a substantially horizontal groove located in the upper margin thereof and an arcuate groove interconnecting therewith at approximately the middle thereof and extending downwardly therefrom. A first- and second-pair of detents are spaced at selective depths along the lower portion of said substantially horizontal groove which pairs of detents cooperate to receive the outwardly extending lugs and, thereby, support the base plate and machine thereon in vertically-elevated, operative positions as selected for flatbed sewing and free-arm sewing. Guiding the pairs of lugs along the substantially horizontal grooves in said wall members to a storage position, enables one of each pair to pivot downwardly into the arcuate groove interconnected with said substantially horizontal groove thereby allowing pivotal movement of the machine into a horizontal, storage position. Such movement into the storage position is facilitated by a slightly downward incline of the substantially horizontal groove at the rear portion thereof whereby the base plate's rear margin will clear the cabinet's other structure as the base plate and machine are pivoted into storage position.

Accordingly, it is a primary object of the present invention to provide a multiple position sewing machine cabinet, using a follower and guide mounting assembly, which cabinet is handy to use and inexpensive to produce in that the use of complicated lifting mechanisms with compression springs and the like is avoided.

Another object of the invention is to provide a novel and improved mounting assembly that can be easily adapted to drophead sewing machines of different styles and manufacture.

A further object of the invention is to provide a novel and improved mounting assembly that will enable storage of sewing machines in a fully horizontal position and thereby provide styling and other advantages in cabinet manufacture and design.

A further object of the invention is to provide a novel and improved mounting assembly that will facilitate easy removal and replacement of the sewing machine for servicing and maintenance.

Still yet another object of the present invention is to provide in combination with the mounting assembly a new and improved follower and guide assembly to support the machine in various vertically-elevated, operative positions and allow pivotal movement thereof into a horizontal, storage position and support the machine in said positions without the use of special support brackets or specially adapted top inserts and the like.

Having in mind the above and other objects that will be evident from an understanding of this disclosure, the invention comprises the devices, combinations and arrangements of parts as illustrated in the presently preferred embodiment of the invention which is hereinafter set forth in such detail as to enable those skilled in the art readily to understand the functions, operation, contruction and advantages of it when read in conjunction with the accompanying drawings in which:

DESCRIPTION OF THE PREFERRED EMBODIMENT

Figure 1:
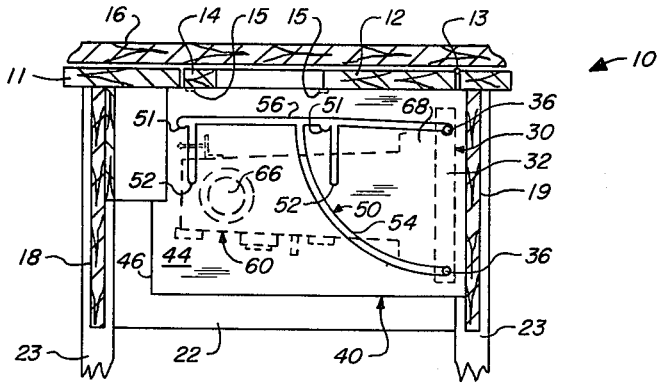
FIG. 1 is a transverse vertical section on the line 1—1 of FIG. 4, with the panels and cover in storage position.

Referring now to the accompanying drawings wherein like reference numerals designate similar parts throughout the various views, a cabinet constructed in accordance with the present invention is illustrated for purposes of explanation only and should not be construed as a limitation of an invention.

The multiple position sewing machine cabinet 10 of the present invention includes a top portion 11 supported by legs 23 in usual table-like configuration. Included also are a front wall 18, rear wall 19 and side walls 21, 22, which walls define an enclosure for the storage of a drophead sewing machine 60 of the type adapted for use selectively in a position for flatbed sewing and a position for free-arm sewing.

An opening 24 is provided in the top 11 and is fitted with a hinged panel 12, connected by hinge members 13, on one side thereof, which panel acts as a closure member for the rear of the opening 24 when the machine 60 is operatively positioned in the front thereof.

Figure 4:
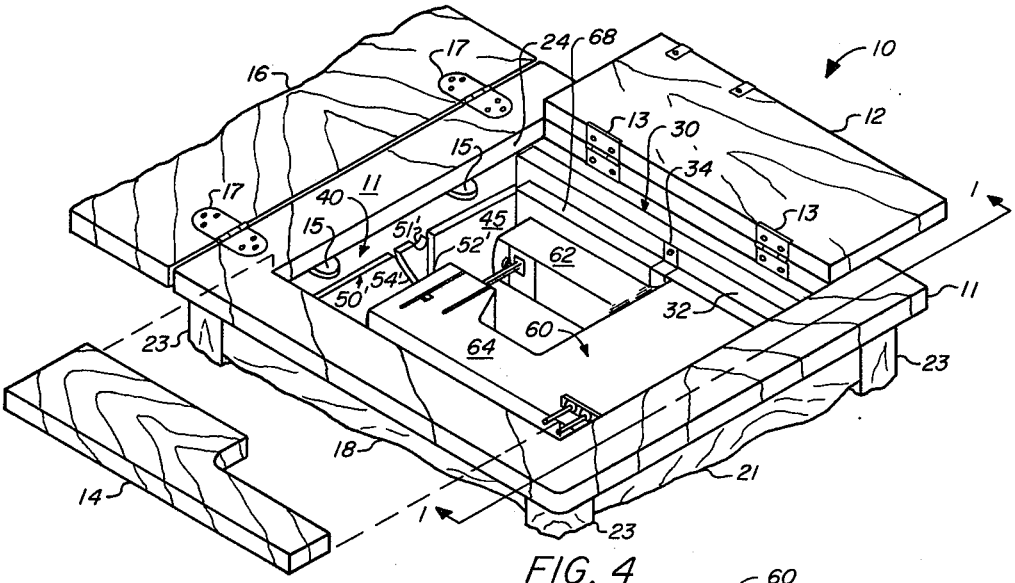
FIG. 4 is a perspective view of the cabinet with the liftout panel dissembled therefrom, the cover and other panels open.

A drop-in panel 14 is adapted to fit in the opening 24 and provide therein a continuation of the top work surface of the top 11. The hinged panel 12 and drop-in panel 14 are supported by bracket pieces 15 secured to the underside of the top 11. A hinged cover 16, pivotally connected to the top 11 by hinge members 17, provides a further continuation of the top work surface when the cover 16 is pivotted to a open position, FIG. 4. The cover 16 forms also a covering closure for the cabinet 10 when pivotted to the closed position as illustrated in FIG. 1.

Figure 5:
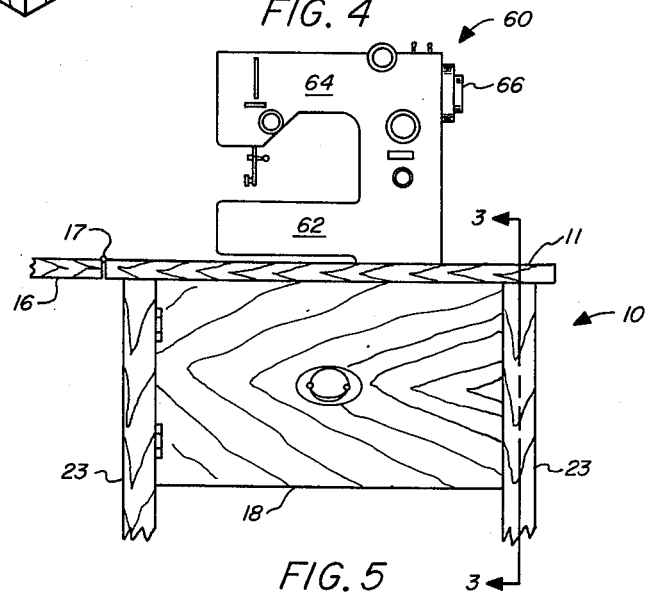
FIG. 5 is a front elevation view of the multiple position sewing machine cabinet of FIG. 3, with the sewing machine illustrated in the free-arm sewing position.
Figure 6:
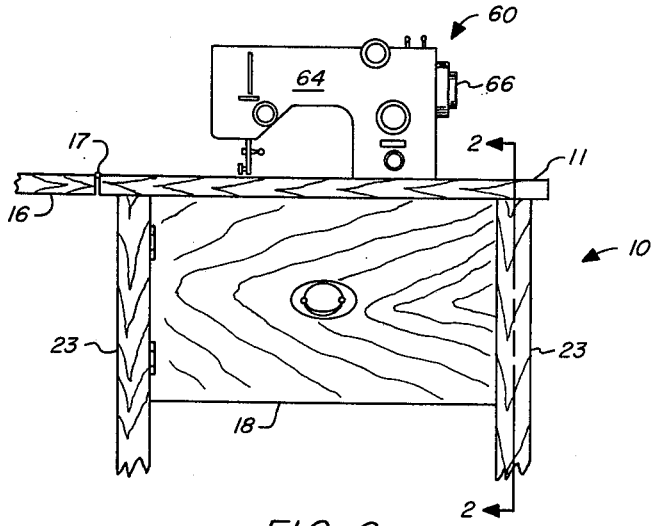
FIG. 6 is a front elevation view of the multiple position sewing machine cabinet of FIG. 2, with the sewing machine illustrated in the flatbed sewing position.

The machine 60 is of the type commonly referred to as a drophead sewing machine and is generally mounted in a cabinet wherein the machine head may be raised to one or more vertical operative positions or may be dropped into a storage position. A free-arm 62 is provided on the machine 60 to receive a tubular work piece for passage therearound as the piece is sewn. For flatbed sewing operations the work surface of the free-arm 62 is positioned at an elevation coextensive with the work surface of the top 11, FIG. 6. For free-arm sewing operations, however, it is elevated to a position above the top 11, FIG. 5. Other than as previously described, the sewing machine 60 is of a conventional sewing machine type, having a head portion 64, hand wheel 66 as well as other structural elements and accessories, and need not be described in further detail in order to provide an understanding of the preferred embodiment of this invention. Also, the parts of the sewing machine cabinet heretofore described are conventional and are described only for environmental purposes.

Figure 7:
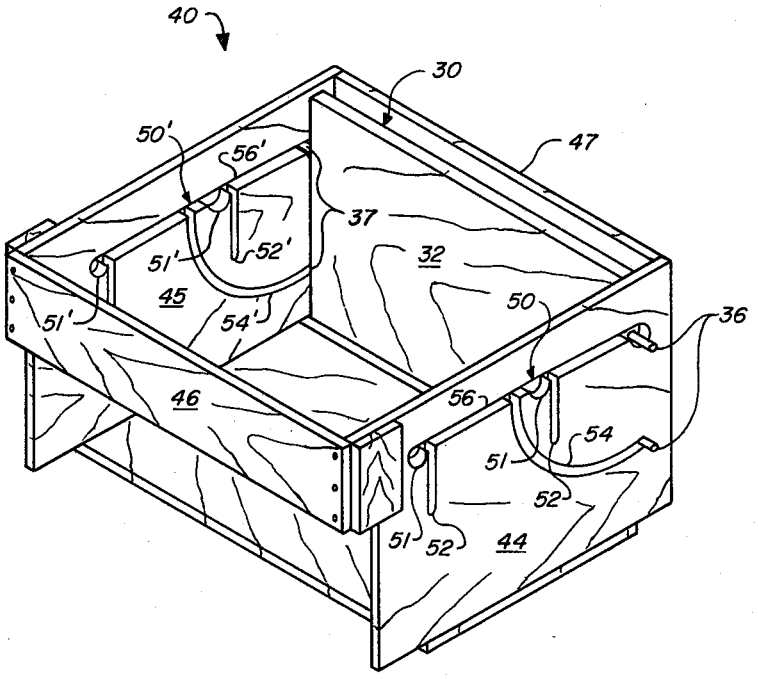
FIG. 7 is a perspective view of the guide and follower mounting assembly without the surrounding cabinet structure.

The novel mounting assembly of the present invention comprises a follower mounting assembly 30 including a base member, such as the base plate 32, which is a rectangular shaped plate adopted to support the drophead sewing machine 60 and has length and width dimensions sufficient to accommodate the corresponding dimensions of the machine 60. A fastening means 34, such as a wing nut and restraining band assembly for example, is used to fixedly attach the sewing machine 60 to the base plate 32. A first and second pair of spaced-apart follower members extend outwardly from opposite ends of the base 32, which members, in the examples, may comprise the lugs 36 and 37 as illustrated in FIG. 7, although a roller type follower might be desired in some cases. The base 32 in cooperation with lugs 36 and 37 forms a stetcher or litter-type support member for the sewing machine 60, and supports the machine in a horizontal, storage position as well as vertically-elevated, operative positions as will be described next.

A guide mounting assembly 40 guides and supports the follower mounting assembly 30 in the various operative and storage positions mentioned in the preceding paragraph. Turning now to FIG. 7, the parallel, spaced-apart side walls 44 and 45 together with the front wall 46 and back wall 47, form a substantially box-like construction that is assembled and fitted inside the sewing machine cabinet 10 as a part thereof. It is obvious, of course, that in the construction of a specific embodiment of the invention herein disclosed, one or more of the wall members 44, 45, 46 or 47 of the assembly 40 could also serve as a corresponding wall member of the cabinet 10, which construction method is used in the example whereby the cabinet rear wall 19 serves also as wall member 47 of the guide mounting assembly 40.

A spaced guide means 50, 50' is provided in the walls 44, 45 and cooperates with the lugs 36, 37 to guide and support the panel 32 with the machine 60 attached thereto. In the example, the spaced guide means 50, 50' includes grooves cut into the parallel, spaced-apart walls, 44, 45, which grooves are cut to provide a substantially horizontal, spaced guide 56, 56' interconnected with an arcuate, spaced guide 54, 54', see FIG. 8. A first pair of spaced detents 51, 51' are positioned to receive the lugs 36, 37 and support the base 30 in a vertical elevation whereby the machine 60 extends above the top 11 a predetermined amount sufficient for free-arm sewing, FIGS. 3 & 5. A second pair of spaced detents 52, 52' positioned adjacent to the first pair, however, extending further below the horizontal spaced groove 56, 56' provide a second vertically-elevated, operative position for the machine 60 relative to the top 11, whereby the machine is elevated relative to the top 11 to a position for flatbed sewing, FIGS. 2 & 6.

Figure 8:
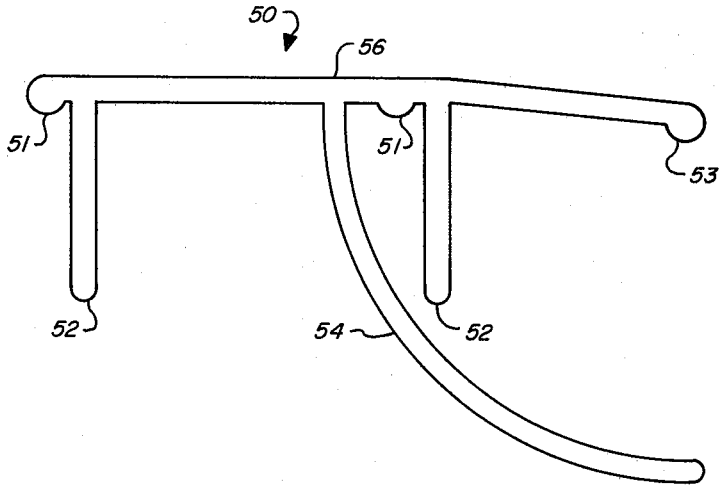
FIG. 8 illustrates schematically, a layout of the groove portion of one parallel, spaced-apart wall member in the guide mounting assembly.

Turning now to FIGS. 7 & 8, a layout of the spaced guide means 50, 50' illustrates more clearly the use of spaced detents 51, 51' and 52, 52' in cooperation with the lugs 36, 37 for positioning of the base 32 in selected vertically-elevated, operative positions. It should be noted, however, that a portion of the horizontal guide 56, 56' is inclined slightly downward to a single spaced detent 53, 53', which in cooperation with the arcuate spaced guide 54, 54' enables pivotal movement of the base 32 into a storage position, FIGS. 1 & 4. Spaced detent 53, 53' together with that portion of the downwardly inclined horizontal, spaced guide 56, 56', provide clearance between the rear edge of the base 32 and other structure of the sewing machine cabinet 10 as the base 32 is pivotted downwardly into the storage position, FIGS. 1 & 4. This permits, among other advantages, the use of materials to construct the base 32 having lower sheer strength, and the like, than would otherwise be required if the lugs 36, 37 were positioned closer to the front and back edges thereof. It should be understood, however, that this construction detail is not to be considered as a limitation to the invention but merely a feature incorporated in the preferred embodiment thereof to accomplish the specific result as described.

The arcuate, spaced groove 54, 54' is constructed on a radius relative to the spaced detents 53, 53', equivalent to the distance between each lug in the spaced apart pairs of lugs 36, 37 thereby enabling the base 32 to be pivotted downwardly when the rear most lugs of each pair is nested in the spaced detents 53, 53'.

Figure 2:
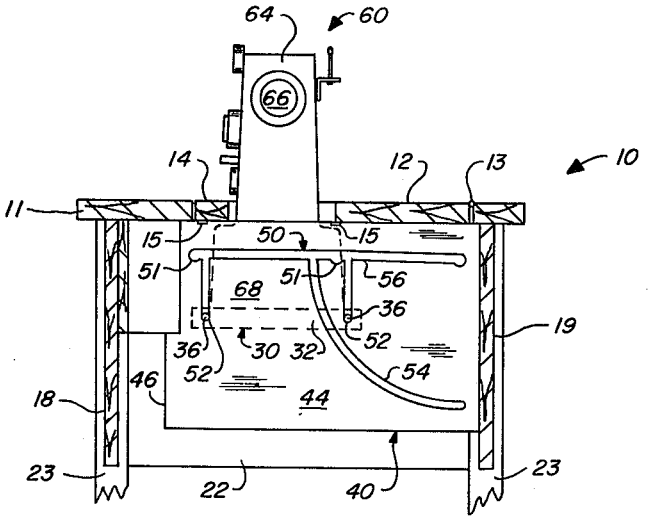
FIG. 2 is a transverse vertical section on the line 2—2 of FIG. 6.
Figure 3:
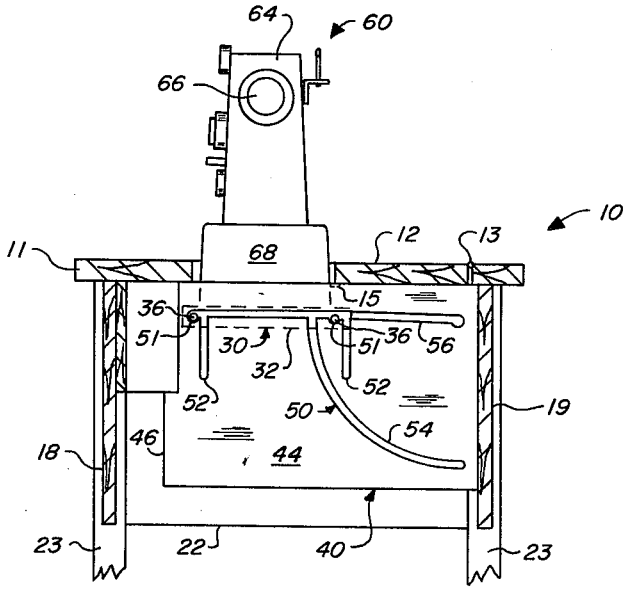
FIG. 3 is a transverse vertical section on the line 3—3 of FIG. 5.

Having now described a preferred embodiment of the novel follower and guide mounting assembly of this invention, its operation can readily be understood with reference to FIGS. 1 through 3. Insofar as that part of the spaced guide means 50, 50' identified by the reference character 50' and its cooperation with the pair of lugs 37 slidably connected therewith, constitute a mirror image of those same elements shown in FIGS. 1 through 3, only the portions shown in the figures will be mentioned in description that follows.

In FIG. 1, the machine 60 is shown in the storage position with the lugs 36, supported by detent 53 and the lower portion of the arcuate guide 54. It is noted that with the machine 60 in a horizontal, storage position the overall depth of the cabinet 10 is reduced, thereby providing increased styling opportunities as well as reducing the cost thereof. Movement of the machine 60 into one of its vertically-elevated, operative positions is accomplished by first pivoting the cover 16 by means of the cover hinges 17 to an open position, lifting out the drop-in panel 14 and pivoting back the hinged panel 12, thereby exposing the machine for pivotal movement from the horizontal storage position into a vertical position. Such pivotal movement is accomplished by lifting upwardly on the head portin 64 and requires minimum lifting in that substantially most of the sewing machine's weight is supported by the lugs 36, 37 as the rear most of each pair pivot in the detent 53 and the front ones slide along the lower portion of the arcuate groove 54.

When the machine 60 is in a vertical position, a slight lifting force is maintained while the machine 60, with the base 30, is slid forward, causing the lugs 36 to slide along the horizontal groove 56 toward the spaced detents 51, 52. If the machine 60 is to be operated in the flatbed sewing position, the lugs 36 are allowed to drop into the lower, second pair of detents 52 and the machine is lowered to a position whereby the freearm 62 is level with the top 11, FIGS. 2 & 6. The hinged panel 12 is pivotted into position to partially close the opening 24 and the lift-out panel 14 is inserted to further close the opening and to provide a contiguous work surface with the top 11 and the upper surface of the free-arm 62, FIG. 6.

Should it be desired to position the machine 60 for free-arm sewing, the drop-in panel 14 is removed and the machine 60 is lifted until the lugs 36 are again at the level of the horizontal groove 56. The machine 60 is moved slightly forward to position the lugs 36 above the first pair of detents 51 and the machine is lowered into operative position. In this position, the drop-in panel 14 is not required and the free-arm 62 is positioned above the top 11 to accommodate a tubular shaped work-piece therearound, FIGS. 3 & 5.

Numerous alterations of the structure herein disclosed will suggest themselves to those skilled in the art. However, it is to be understood that the present disclosure relates to a perferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In combination with a multiple position sewing machine cabinet and a drophead sewing machine adapted for use in multiple operative positions, a follower and guide mounting assembly for slidably mounting the sewing machine head to the cabinet and permitting its movement from a horizontal, storage position within the cabinet to one or more vertically-elevated, operative positions above the cabinet, said mounting assembly comprising:

a base with means for securing said sewing machine thereto;

pairs of spaced-apart follower members extending outwardly from opposite ends of said base; and spaced guide means including:

a pair of parallel, spaced-apart wall members;

grooves in each of said wall members forming a substantially horizontal, spaced guide with an arcuate, spaced guide interconnecting therewith and extending downwardly therefrom; and support means cooperating with said spaced guides to selectively support said base member in a storage position and in one or more vertically-elevated operative positions.

2. The assembly of claim 1, wherein said support means includes:

a first pair of detents and a second pair of detents, the detents in said pairs having a distance therebetween substantially equal to the corresponding distance between the follower members in each spaced-apart pair, each of said pairs of detents interconnecting with said substantially horizontal, spaced guide at a selected vertical distance therebelow to receive said follower members therein and support said base member in selected vertically-elevated, operative positions.

3. In combination with a multiple position sewing machine cabinet and a drophead sewing machine adapted for use in multiple, operative positions, a follower and guide mounting assembly for slidably mounting the sewing machine head to the cabinet and permitting its movement from a horizontal, storage position within the cabinet to one or more vertically-elevated, operative positions above the cabinet, said mounting assembly comprising:

a base member having length and depth dimensions to accommodate the corresponding dimensions of the sewing machine;

fastening means securing said sewing machine to said base;

a first pair of spaced-apart follower members on one end of said base and a second pair of spaced-apart follower members on the opposite end thereof, said pairs of spaced-apart follower members comprising lugs extending outwardly from opposite ends of said base member and forming therewith a litter-type support member for the sewing machine; and a spaced guide means including:

a pair of parallel, spaced-apart wall members;

grooves in each of said wall members forming a substantially horizontal, spaced guide with an arcuate, spaced guide interconnecting therewith and extending downwardly therefrom; and a first pair of detents and a second pair of detents, the detents in said pairs having a distance therebetween substantially equal to the corresponding distance between the follower members in each spaced-apart pair, each of said pairs of detents interconnecting with said substantially horizontal, spaced guide at a selected vertical distance therebelow to receive said follower members therein and support said base member in selected vertically-elevated, operative positions.

* * * * *